US006598881B1

(12) United States Patent
Shoemaker, Jr.

(10) Patent No.: US 6,598,881 B1
(45) Date of Patent: Jul. 29, 2003

(54) CRANE GAME WITH PRIZE REDISTRIBUTION MECHANISM

(76) Inventor: Stephen P. Shoemaker, Jr., 531 N. Franeisca Ave., Redondo Beach, CA (US) 90277

( * ) Notice: Subject to any disclaimer, the term of this patent is extended or adjusted under 35 U.S.C. 154(b) by 0 days.

(21) Appl. No.: 10/288,726

(22) Filed: Nov. 6, 2002

(51) Int. Cl.[7] ..... A63F 7/36
(52) U.S. Cl. ..... 273/447
(58) Field of Search ..... 273/440, 447, 273/441, 448, 454; 221/192, 244

(56) References Cited

U.S. PATENT DOCUMENTS 4,496,074 A * 1/1985 Owens ..... 221/39
5,397,134 A * 3/1995 Fishman et al. ..... 463/25
5,855,374 A * 1/1999 Shoemaker, Jr. ..... 273/447
6,196,415 B1 * 3/2001 Sullivan ..... 221/192
6,428,008 B1 * 8/2002 Singer ..... 273/447

* cited by examiner

*Primary Examiner*—Raleigh W. Chiu
(74) *Attorney, Agent, or Firm*—Fulwider Patton Lee & Utecht, LLP

(57) ABSTRACT

The invention relates to an amusement device such as a crane game of the kind including a plurality of prizes in a collection bin for withdrawal, the crane game including a floor upon which the prizes rest that can be vertically shifted as prizes are withdrawn to maintain the appearance of a full prize bin. The floor shifting mechanism comprises a motor coupled to an endless belt or chain that drives one or more threaded members to control the movement of the floor in the vertical direction. The invention may include a vibrator for imparting an oscillation to the prizes that redistributes the prizes toward a more level arrangement to place more prizes within the game's participation.

14 Claims, 3 Drawing Sheets

CRANE GAME WITH PRIZE REDISTRIBUTION MECHANISM

BACKGROUND OF THE INVENTION

The present invention is directed to an amusement device comprising a bin of prizes and an overhanging crane that is maneuvered over the bin of prizes in an attempt to retrieve the prize from the bin, also referred to generally as a "crane game," and more particularly to a prize level maintaining system for maintaining the upper layer of prizes in a substantially level and elevationally constant configuration.

Crane games of the type shown in FIG. 1 are a popular attraction in arcades, stores, amusement parks, and the like. The game typically involves a large bin with transparent windows to reveal a collection of prizes, toys, food stuffs, or other items at the bottom of the bin. Using either a joystick control as shown, or other various well known manual input systems, the user attempts to control an overhanging crane mechanism suspended above the prizes. The crane can be maneuvered along a two dimensional track system above the prizes until the desired prize is directly below the overhanging crane mechanism. At that point, the user initiates a lowering of the crane mechanism until contact is made with the prizes, at which point the crane mechanism attempts to withdraw a prize by closing-the claw members together. If a prize is successfully captured by the crane mechanism, the crane and prize are immediately raised up by the connected tether and the drive system automatically returns the crane to a position over a hatch or chute that leads to a compartment accessible by the player. The prize is automatically dropped into the hatch or chute and the player retrieves the prize from the compartment.

There are many variations to the crane game just described including variations on the crane mechanism. For example, the use of an improved claw for use in capturing odd shaped prizes can be employed such as that disclosed in U.S. Pat. No. 6,234,487, or a vacuum suction member can be substituted for the claw member for retrieving prizes as disclosed in U.S. Pat. No. 5,855,374, the disclosures of both references are fully incorporated herein. When a vacuum crane is used the prizes in the bin are typically objects with a smooth and regular surface to permit the vacuum crane to engage to the object. Irregularly shaped objects such as those shown in FIG. 1 can be more difficult to retrieve with a vacuum crane type mechanism due to the mismatch in surfaces between the vacuum and the prize. There is also a variety of ways in which the manipulation of the overhanging crane can be maneuvered by a user. In one example, a first button is pressed in order to initiate a translation of the overhanging crane from a further most left position to a direction to the right. A second button stops the progress of the crane as it translates. Pressing the button again will begin the translation of the crane from a front position towards the back of the bin, and pressing the button again will stop the movement of the crane towards the back of the bin, setting the two dimensional position of the crane. The crane then automatically drops in the fixed position and the crane attempts to grasp an object immediately below the crane mechanism. The specific operation of the crane itself is for background only and does not impact the scope of the present invention.

There are several drawbacks inherent in each of the design variations of the crane game described above. First, if enough prizes are withdrawn from the bin, then the game appears to be depleted even if there are numerous prizes remaining along the bottom of the bin. It has been shown that a depleted looking game attracts fewer users, and as such, the prize bin needs to be refilled on a regular basis. However, because the usage of the game or the success of the players may be inconsistent or sporadic, the contents of the bin must be checked frequently. Another drawback of the game is that prizes are typically withdrawn from the middle portion of the bin leaving an unequal distribution of prizes along the outer periphery. This again leads to a depleted looking bin, and renders many of the prizes inaccessible due to limitations of the crane mechanism's movement along the bin's periphery. Accordingly, the art would benefit from a crane game that includes a solution to the requirement for frequent checking of the prize bin's level and distribution.

SUMMARY OF THE INVENTION

The present invention is directed to a crane game including a prize bin with a floor that can be moved vertically within the bin to change the apparent capacity of the prize bin. The floor is moved independently from the walls of the bin to increase or reduce the capacity of the bin, and thereby raise and lower the prizes supported on the floor within the bin. When the prize quantity drops below a desired level, an upward movement of the floor raises the prize level and gives the appearance that the bin is full with prizes. The operation can be performed either by a user initiating the floor adjustment, or automatically using sensors that detect the prize level and initiate the operation when the prize level falls below a predetermined elevation or other criteria. The operation is preferably performed using a drive system below the bin's floor that raises and lowers the floor continuously or incrementally with a stepper motor or a screw-drive system. In a preferred embodiment the drive system comprises a motor that drives a belt or chain member to rotate a plurality of support rods. The support rods are threaded and cooperated with threaded mounting collars on the floor such that a rotation of the support rods imparts a vertical movement of the threaded collars, which in turn moves the floor in the vertical direction. The present invention may also preferably include a vibrational device such as an eccentric motor in communication with the floor. Activation of the vibrational device imparts a jostling action to the prizes which tends to redistribute the prizes from an uneven configuration to a substantially even upper layer of prizes. The vibrational member and the floor drive mechanism may be operated independently or in connection with each other. The actuation of the floor drive system can be initiated by a sensing of the prize level, an determination of an elapsed time, a determination of a number of games played, or after a predetermined number of successful prize removals. Similarly, the vibrational device can be actuated in response to similar conditions or occurrences.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
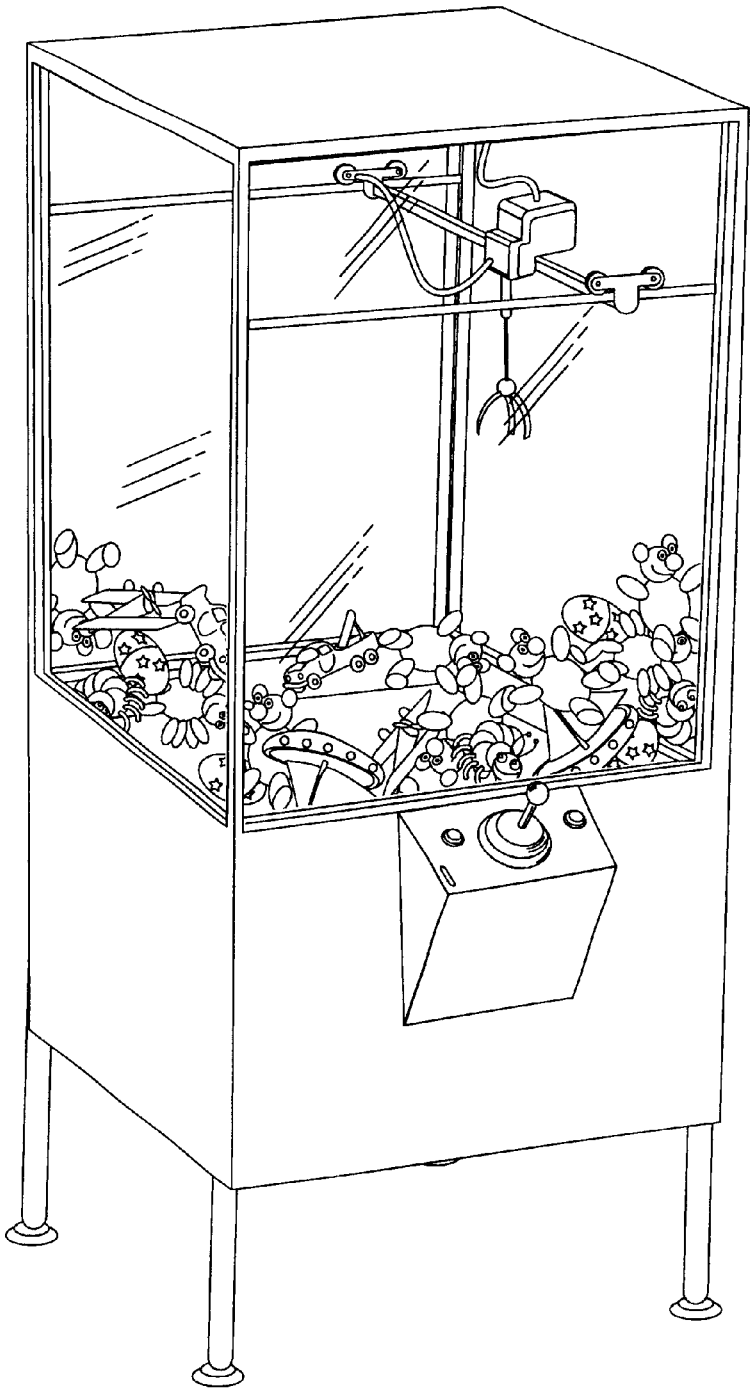
Fig. 1 (Prior Art)
FIG. 1 is an elevated perspective view of a crane game of the prior art.

The present invention is directed to a system for adjusting the prize level in a crane game amusement device of the type shown in FIG. 1 where the object of the game is to extract prizes via a crane from a collection bin. As prizes are extracted from the bin by a user, the prize level adjusting system will adjust the height of the upper layer of prizes to give the appearance that the prize bin is substantially full and evenly distributed. The foregoing extends the time between required maintenance of the machine and reduces the stock of prizes that would otherwise be necessary to maintain a full appearing bin.

Figure 2:
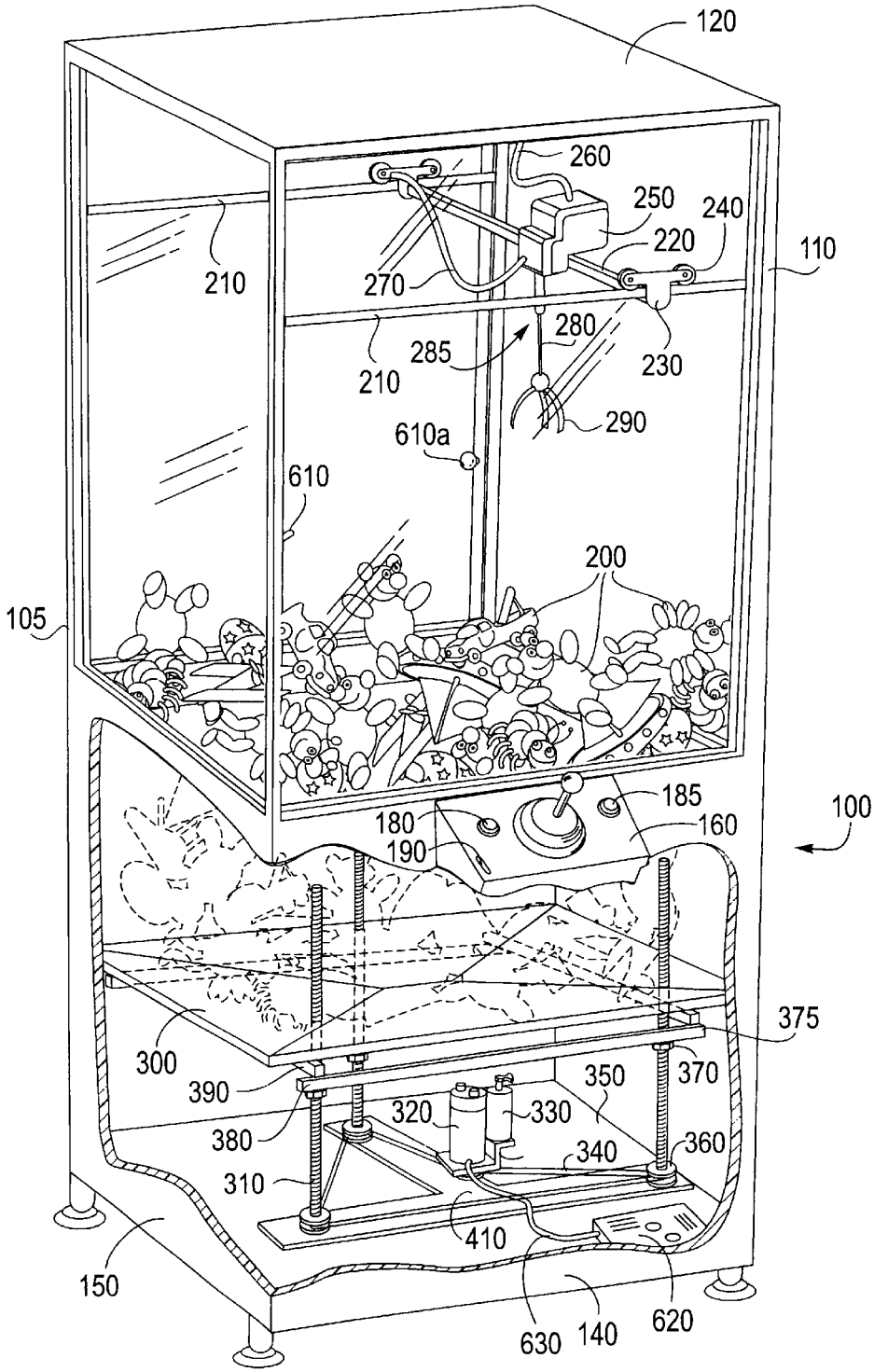
FIG. 2 is an elevated perspective view, partially cut away, of a crane game embodying a first preferred embodiment of the present invention.
Figure 3:
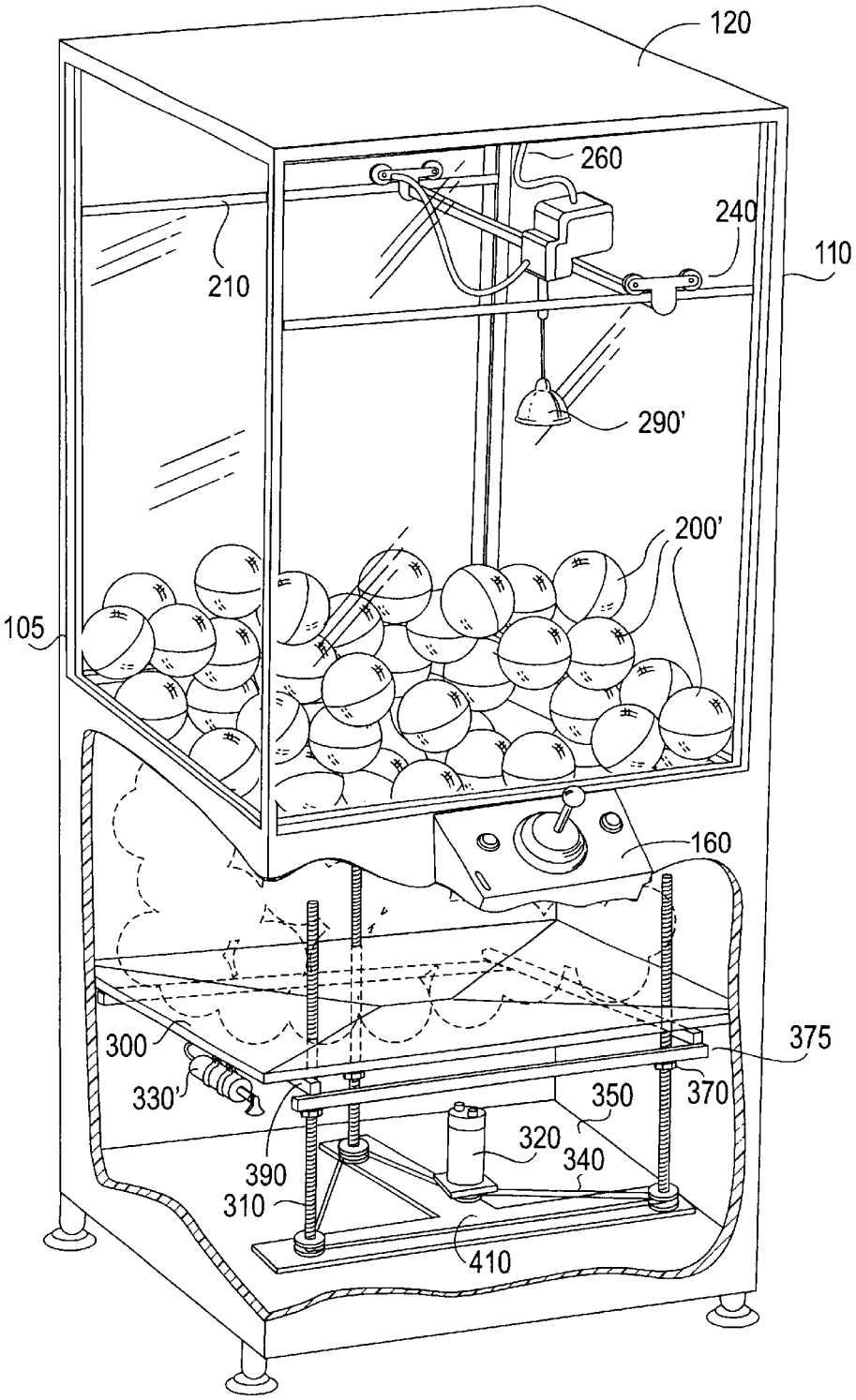
FIG. 3 is an elevated perspective view of a crane game of the present invention illustrating a second embodiment.

The present invention as shown in FIGS. 2 and 3 comprises a floor panel for supporting a plurality of prizes 200 in the crane game 100. The floor panel 300 is preferably not fixed to the walls 140,150 of the game housing 105, but rather the floor panel 300 is supported in a vertically adjustable arrangement between the walls by a plurality of vertically extending threaded rods 310 mounted below the floor panel to bottom wall 350. The floor panel 300 is mounted on an open horizontal frame or platform 375 comprising traverse bars 380 and longitudinal bars 390 connected at respective end portions to form a substantially rectangular support for the floor panel. Internally threaded collars 370 support the horizontal frame 375 at the traverse bars 380. The internal threads of the threaded collars 370 engage the external threads of the threaded rod 310 whereby rotation of the threaded rods impart a vertical translation of the horizontal frame 375 above the threaded collars. Rotation of the threaded rods in a first direction raises the horizontal frame 375 and the bin's floor panel 300, and rotation in the opposite direction lowers the horizontal frame and the bin's floor panel 300.

Rotation of the threaded rods 310 may be carried out through a motor 320 coupled to the threaded rods via a belt or chain 340 or other linking type member. The motor 320 is mounted on a bracket 400 which in turn is mounted to the bottom wall 350 of the housing 105 of the crane game at a brace 410. Rotation of the motor's shaft (not shown) drives the chain member 340 about the hubs 360 mounted to the lower portion of the threaded rods 310. The hubs 360 are configured such as with a sprocket to translate the rotation of the chain member into a rotation of the threaded rod members 310. As the chain member 340 rotates the hubs 360, the threaded rods rotate within the threaded collars 370 to raise or lower the horizontal frame 375 and the floor panel 300.

Also mounted on the motor bracket 400 is a second eccentric motor 330 for imparting a vibration or oscillation to the floor panel 300. The eccentric motor 330 oscillates when actuated to create a vibration that is transferred from the support bracket 400 to the brace 410 and through the threaded rods 310. The vibration of the threaded rods causes a vibration of the floor panel 300 which shakes and jostles the prizes 200 supported thereon and redistributes configurations of prizes due to uneven extraction patterns. That is, when prizes are extracted predominantly from the middle of the prize bin, prizes will tend to collect at the periphery of the bin where it may be difficult or impossible for the crane 285 to extract the prizes 200. The vibration of the floor panel 300 causes prizes collected along the edges of the bin to redistribute in the middle of the bin placing more prizes in play for the player.

Actuation of the motor 320 can be achieved by a processor 620 connected to the motor 320 by cables 630. The processor actuates the motor based on criteria stored in the processor's memory. One criteria for actuating the motor 320 can be tied to the current level of prizes as determined by an optical sensor located in the bin. The optical sensor 610,610*a* can be located on the side walls of the bin at diagonal corners as shown in FIG. 2, or an echo-type sensor (not shown) can be located on the crane looking down into the bin or the top of the bin. Alternatively, a pressure sensor (not shown) on the bottom of the bin can be used to assess the weight of the bin's contents, which in turn estimates the level of the prizes. If the sensor determines that the prize level has fallen below a critical level, the sensor generates a signal that is communicated to the processor to actuate the motor 320 and raise the elevation of the floor 300. The floor panel 300 is then raised a predetermined amount such that the prize level is no longer below the critical elevation. Alternatively, the actuation of the motor can be tied to the number of attempts or successful extraction of the prizes. For example, after every ten attempts the floor panel is raised via the motor 320, or after every ten prizes are successfully extracted from the bin. Alternatively, the motor can be actuated as part of a shutdown procedure at the end of the day or as part of an initiation procedure at the beginning of the day to place the floor level at an appropriate elevation. The motor may be alternatively controlled by a switch (not shown) that turns the motor on and off and also controls the direction of the motor.

The operation of the invention follows from the above description. In the Figures, a crane mechanism 285 is comprised of a claw member 290 suspended by a tether 280 that is mounted on a reel withing a housing 250. The housing 250 is mounted on a beam 220 that spans the bin 110 in the Y-direction. The beam 220 is in turn mounted on a carriage assembly 230 at each end including wheels 240 that ride on longitudinal beams 210 for movement in the X-direction. The carriage assembly 230 and the reel housing 250 are controlled for movement along their respective beams via signals received from cable 270 and cable 260, respectively. The signals are generated from movement of the joystick 170 to maneuver the crane mechanism 285 in the X-Y direction. A button 180 may be used to lower the crane mechanism in the Z-direction, and another button 185 may be used to actuate the claw member 290. A coin slot 190 is provided for receiving a coin or token to begin the game.

A player thus inserts a token or coin into the slot 190 and manually maneuvers the joystick as the crane mechanism 285 travels in responsive movements in the X-Y plane as the housing 250 and carriages 230 receive commands via cables 260,270 to control the crane. Once positioned over the selected target, the player presses the button 180 causing the crane to lower until contact is made with the prizes 200 below. The crane may be actuated by pressing button 185, which may or may not capture the intended target. The crane is then automatically raised and the maneuvered over a chute or hatch typically located at the periphery of the bin and the crane spreads apart to release any captured prize. The chute (not shown) leads to a compartment that is accessible to the player for collecting his prize. Alternatively, as shown in FIG. 3 the claw member can be replaced with a suction member 290' for capturing spherical prizes 200'.

After a certain number of prizes have been removed from the bin, the level of the uppermost prizes will gradually drop. The present invention raises that level by raising the floor 300 that supports the prizes. A signal is sent from a processor 620 to the motor 320 in response to a sensing that the prize level has dropped by the sensor 610, initiating a rotation of the motor spindle or shaft, which in turn drives the belt or chain 340 around the hubs 360. The hubs 360 are mounted to the threaded vertically disposed rods 310, and rotation of the hubs from the belt or chain imparts a rotation of the threaded rods in a common direction. The rotating rods support a horizontal frame 375 connected to the floor 300, and each threaded rod includes a threaded collar 370 cooperating with the associated threaded rod to raise or lower the platform 375. The raised floor moves the collection of prizes upward to give the appearance that the bin is full. A signal is also sent periodically or in concert with the first signal to actuate the eccentric motor 330, which creates a vibration that is transferred to the bracket 400, and to the threaded rods 310, which causes the floor panel to vibrate. The vibration of the floor panel jostles the configuration of the prizes as constituted such that piled prizes will tend to fall and more evenly distribute the upper level of the prizes. This places more prizes in play and gives the appearance of a fuller bin, necessitating fewer maintenance trips to restock and redistribute the prizes in the bin. FIG. 3 illustrates an alternative location for the eccentric motor in direct contact with the floor panel to more efficiently transfer the vibrational movement of the invention.

While a particular form of the invention has been illustrated and described, it will also be apparent that various modifications can be made without departing from the spirit and scope of the invention. Accordingly, it is not intended that the invention be limited, except as by the appended claims.

What is claimed is:

1. A crane game amusement device comprising:

a bin for storing a plurality of prizes, said bin including transparent panes for viewing the prizes from outside the bin and a floor panel for supporting the plurality of prizes;

a prize retrieval system for extracting a prize from above, said prize retrieval system including a crane operable by a user to pick up a prize and remove the prize from the bin;

user input means for controlling the prize retrieval system; and floor panel translation means for moving the floor panel vertically within the bin.

2. The crane game amusement device of claim 1 wherein the floor panel translation means comprises a drive system including a threaded rod coupled to a motor to rotate the threaded rod when the motor is actuated, the rotation of the threaded rod imparting a traverse movement of the floor panel in the vertical direction.

3. The crane game amusement device of claim 2 wherein the floor panel translation means includes a chain member coupling the motor to the threaded rod.

4. The crane game amusement device of claim 3 wherein the floor panel is supported on a platform that engages the threaded rod in a threaded relationship such that rotation of the threaded rod moves the platform vertically.

5. The crane game amusement device of claim 4 further comprising automatic motor controlling means for actuating the motor that moves the platform.

6. The crane game amusement device of claim 5 further comprises a sensor for indicating when a level of prizes has decreased below a predetermined level, and wherein the automatic motor controlling means actuates the motor that moves the platform to raise the platform in response to a signal from the sensor indicating the prize level has decreased below the predetermined level.

7. The crane game amusement device of claim 5 wherein the automatic motor controlling means actuates the motor after a predetermined number of attempts to extract a prize.

8. The crane game amusement device of claim 5 wherein the automatic motor controlling means actuates the motor after a predetermined number of prizes have been extracted.

9. The crane game amusement device of claim 1 further comprising an oscillator in communication with the floor panel for imparting a vibration on the floor panel to redistribute prizes supported thereon.

10. The crane game amusement device of claim 9 wherein the oscillator comprises an eccentric motor.

11. The crane game amusement device of claim 1 wherein the crane includes a vacuum member tethered to an overhead boom.

12. The crane game amusement device of claim 1 wherein the crane includes a claw member tethered to an overhead boom.

13. The crane game amusement device of claim 1 wherein the prizes are substantially spherical.

14. An improved amusement device having a plurality of prizes in a bin and a crane for extracting the prizes, the improvement comprising:

a floor panel vertically movable within the bin, said plurality of prizes supported by the floor panel;

a drive system for lifting the floor panel as prizes are withdrawn from the bin.

* * * * *